US006123275A

United States Patent [19]

Geiger et al.

[11] Patent Number: 6,123,275

[45] Date of Patent: Sep. 26, 2000

[54] DUAL GAP FUEL INJECTOR

[75] Inventors: Gail E. Geiger, Caledonia; David Wesley Rogers, Henrietta; Joseph George Spakowski, Rochester, all of N.Y.

[73] Assignee: Delphi Technologies, Inc., Troy, Mich.

[21] Appl. No.: 09/372,727

[22] Filed: Aug. 12, 1999

[51] Int. Cl.[7] ..... F02M 51/06

[52] U.S. Cl. ..... 239/585.3; 239/585.1

[58] Field of Search ..... 239/585.1, 585.3–585.5; 251/129.15, 129.16, 129.21

[56] References Cited

U.S. PATENT DOCUMENTS 5,127,585 7/1992 Mesinch ..... 239/585.3 X
5,417,373 5/1995 Facchin ..... 239/585.3

*Primary Examiner*—Lesley D. Morris
*Attorney, Agent, or Firm*—John A. VanOphem

[57] ABSTRACT

An electromagnetic fuel injector has an upper, middle and lower body. A solenoid and guide tube are mounted within the middle body. A plug is mounted within the guide tube. The armature moves from its lower position when the solenoid is not energized to its upper position. There are two air gaps which are closed when the armature moves to its upper position, one between the armature and a stop shoulder on the middle body and the other between the armature and the plug. During assembly, the plug is inserted partially into the guide tube. Next, the armature is inserted into the guide tube. The armature is pushed upward until it contacts a stop on the middle body. The armature and the plug then stop moving. Because the plug is in a tight fitting relationship with the upper body, it remains in place when the armature is moved back to its lower position. This positions the plug such that the two air gaps are equal. The second air gap is positioned between the top and bottom of the solenoid. A spring is positioned between an adjusting member and the armature. A flat disk spring is between a spacer and the lower body. The armature is located on one side of the spring and the pintle is located on the other side. The middle body, solenoid and armature are reversible and can be used in an outwardly or inwardly opening injector.

12 Claims, 3 Drawing Sheets

DUAL GAP FUEL INJECTOR

TECHNICAL FIELD

This invention relates to a fuel injector for an internal combustion engine. More particularly, this invention relates to an electromagnetically controlled fuel injector for injection of gasoline or fuel into the combustion chamber of the engine.

BACKGROUND OF THE INVENTION

Various types of electromagnetic fuel injectors are used in the fuel injection systems of internal combustion engines. Such injectors, as well as other solenoid controlled valve structures, have been used which have a solenoid armature located between the pole piece of the solenoid and a fixed valve seat whereby the armature operates the valve member. Examples of such electromagnetic fuel injectors or solenoid controlled valve structures are described in U.S. Pat. No. 4,515,129 issued May 7, 1985 to Stettner and U.S. Pat. No. 4,572,436 issued Feb. 25, 1986 to Stettner et al. The above identified patents show arrangements in which an armature/valve is biased to a normally closed position against a fixed valve seat by a spring member. The armature/valve is operable between a seated, sealing position against the valve seat and an open position against a pole piece of the solenoid for controlling flow through a fuel injector port in the valve seat.

In the past, fuel injectors have been used to inject fuel onto the back of the intake valve of the engine, such as the injector described in U.S. Pat. No. 5,577,481 issued Nov. 26, 1996 to Wahba. This type of fuel injector is known as a port fuel injector. Other injectors inject fuel into the engine's intake manifold. Recently, fuel injectors have been used to inject fuel directly into the cylinder of the engine. This type of injector is known as a direct injection injector. For direct injection, it is desirable to have the injector as small as possible to fit within the limited space surrounding each cylinder of the engine. Fuel injectors have typically had outside diameters of 22 mm or larger. When the size of an injector is reduced, it is difficult to design a solenoid which generates sufficient force, using a twelve volt system, to achieve the desired control and flow requirements.

Therefore, a fuel injector is needed which is relatively small in size, yet has a solenoid which generates sufficient force to achieve the desired flow of fuel through the injector.

In addition, fuel injectors are either outwardly opening or inwardly opening. In an outwardly opening injector, the valve moves down away from the solenoid to open and is drawn up into the valve seat to close. In an inwardly opening injector, the valve is drawn up toward the solenoid to open the injector and moves down into the valve seat to close the injector. It is desirable to have shared parts with these two types of injectors to increase manufacturing efficiencies.

SUMMARY OF THE INVENTION

The electromagnetic fuel injector of the present invention includes an upper body section having an axial fuel passage through it. The upper body section includes a cavity at its lower end. A middle body section is attached to the upper body section and has a cylindrical cavity with a horizontal stop shoulder extending partially into the cavity. A guide tube is mounted within the middle body section and is preferably welded in place. The portion of the cavity of the middle body section above the stop shoulder and outside of the guide tube defines a dry cavity which receives a solenoid.

The solenoid has a top end and a bottom end with windings around a core, as is known in the art. The solenoid, when energized, exerts an axial force on an armature in a direction toward the upper body. The solenoid has terminals which exit the fuel injector in a vertical orientation adjacent the upper body section.

The armature is mounted for axial movement within the guide tube and has a fuel passage through it. The armature is biased in a direction away from the upper body. The armature has an upper section which is cylindrical and has a lower section which is also cylindrical. The lower section has a larger diameter than the upper section. The top of the lower section of the armature defines a first shoulder and the top of the upper section of the armature defines a second shoulder.

A plug is mounted within the guide tube in a tight fitting relationship with the guide tube. The top of the plug is received within the cavity in the upper body. The armature moves from its lower position when the solenoid is not energized to its upper position when the solenoid is energized. In the upper position, the first shoulder of the armature contacts the stop shoulder of the body section and the second shoulder of the armature contacts the plug. Thus, there are two air gaps which are closed when the armature moves from its lower position to its upper position, one between the armature and the stop shoulder on the middle body section and the other between the armature and the plug. The two air gaps must be equal in height, otherwise, the armature will stop after contacting only one of the two stops. In prior designs having two air gaps, it was difficult to ensure that the two air gaps were equal. The present invention includes a novel design to ensure that the air gaps are equal.

During assembly, the plug is inserted into the guide tube and partially into the cavity in the upper body. Next the armature is inserted into the guide tube. The top of the armature (the second shoulder) contacts the plug. The armature is pushed upward until the first shoulder of the armature contacts the stop shoulder of the middle body section. When this occurs the armature and the plug both stop moving. Because the plug is in a tight fitting relationship with the upper body, it will remain in place when the armature is moved back to its lower position. Thus, the plug member has been positioned in the cavity in the precise location to ensure that the air gaps between the armature and plug and between the armature and stop shoulder will be equal when the armature moves to its lower position.

The highest magnetic force generated by the solenoid is between the top and bottom of the solenoid core. Thus, the second air gap is optimally positioned between the top and bottom of the solenoid core. By using two gaps, and placing one of the gaps between the top and bottom of the solenoid core, the solenoid generates sufficient force, using a twelve volt system, such that the solenoid can fit within a fuel injector having an outside diameter of 17 mm.

A spacer is located within the middle body section and surrounds the lower portion of the armature. A lower body section is attached to the middle body section. The top of the lower body section forms a shoulder which acts as a stop to the downward movement of the armature. A pintle is connected to the armature and is disposed axially within the fuel injector. The pintle has at least one fuel passage through it. The pintle is connected to a valve, as is known in the art.

Preferably, the fuel injector has two springs, a low rate spring and a high rate spring. A spring adjusting member is located within the fuel passage of the upper body and has a shoulder at its bottom end. The low rate spring is positioned between the shoulder of the spring adjusting member and a spring shoulder on the inside diameter of the armature. The low rate spring has a rate on the order of 10 Newtons per millimeter. The high rate spring is in the form of a flat disk of corrosion resistant material such as stainless steel. A suitable high rate spring has a rate on the order of 200 Newtons per millimeter. The high rate spring is between the spacer and the lower body section and is supported by the spacer. The spacer position determines the amount of preload, if any, and the high rate spring deflection. The high rate spring has a hole through its center. The armature is located on one side of the high rate spring and the pintle is located on the other side of the high rate spring. Thus, the high rate spring is trapped between the armature and the pintle. As the armature and pintle move upward under the force of the solenoid, both the high rate spring and the low rate spring act to bias the pintle in a direction away from the upper body. It will be understood by those of ordinary skill in the art that in some applications, either the high rate spring or the low rate spring could be eliminated.

The lower body section has a valve seat for receiving a valve member. When the pintle is moved upward by the solenoid, the valve member is lifted off of the valve seat to permit fuel to exit the fuel injector from its injection port.

The foregoing describes an inwardly opening fuel injector. Another novel aspect of the invention allows certain parts of the fuel injector to be reversed in orientation for use in an outwardly opening fuel injector. If the fuel injector has modular parts, i.e. if the middle body section is not integral with either the upper body section or the lower body section, the orientation of the middle body member could be reversed. The armature and solenoid are also designed to be reversible such that upon energizing the solenoid, the armature would move down instead of up. In this orientation, a different upper body section and lower body section would be used. Also, a different pintle would be used which is adapted to be attached to the armature in the opposite orientation.

These and other objects and features of the invention will become apparent by reference to the following description and to the drawings.

DESCRIPTION OF THE PREFERRED EMBODIMENT

Figure 1:
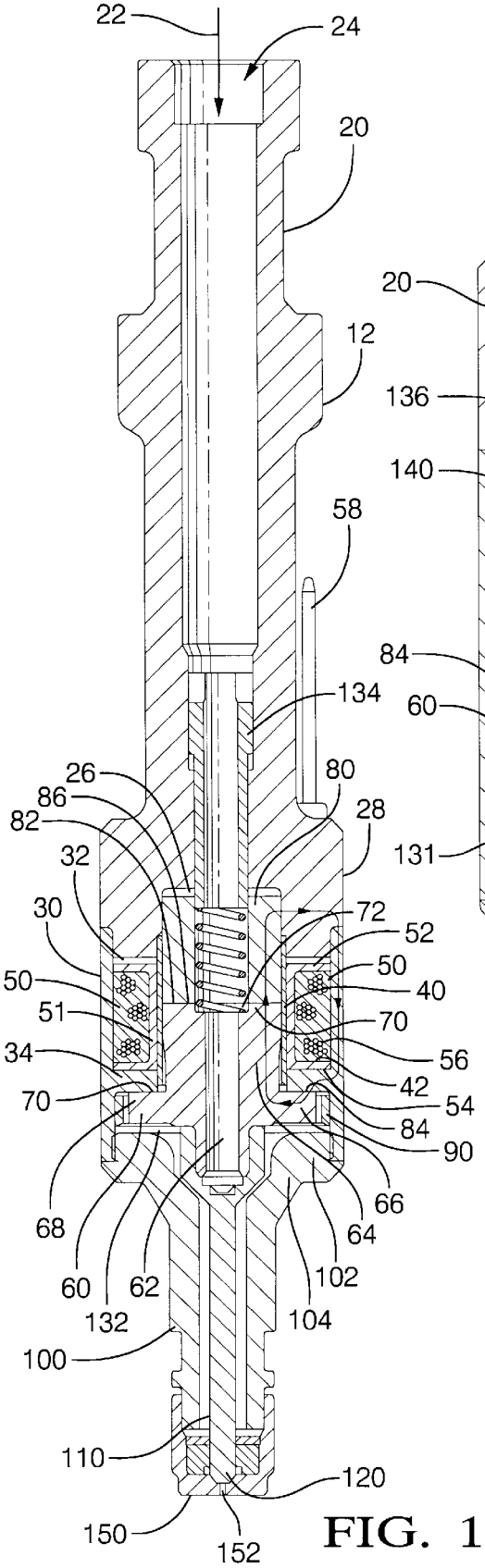
FIG. 1 is a cross-sectional view of an inwardly opening fuel injector incorporating the present invention.
Figure 3:
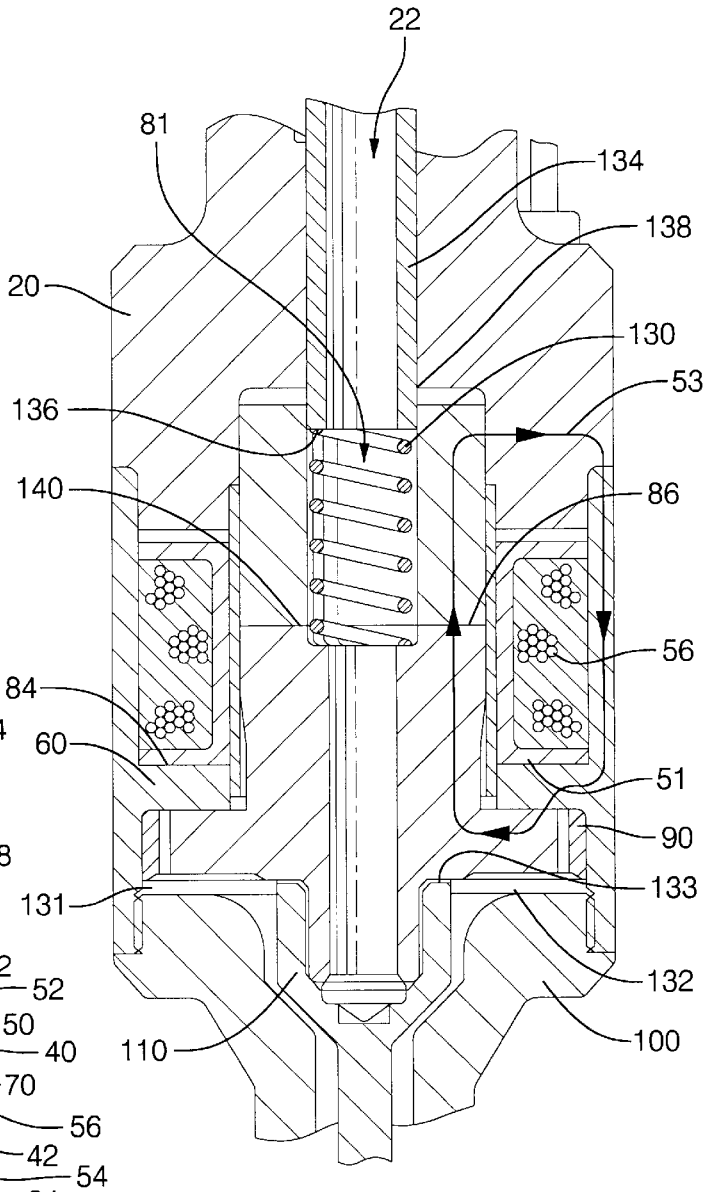
FIG. 3 is a cross-sectional view of a portion of the fuel injector shown in FIG. 1.
Figure 2:
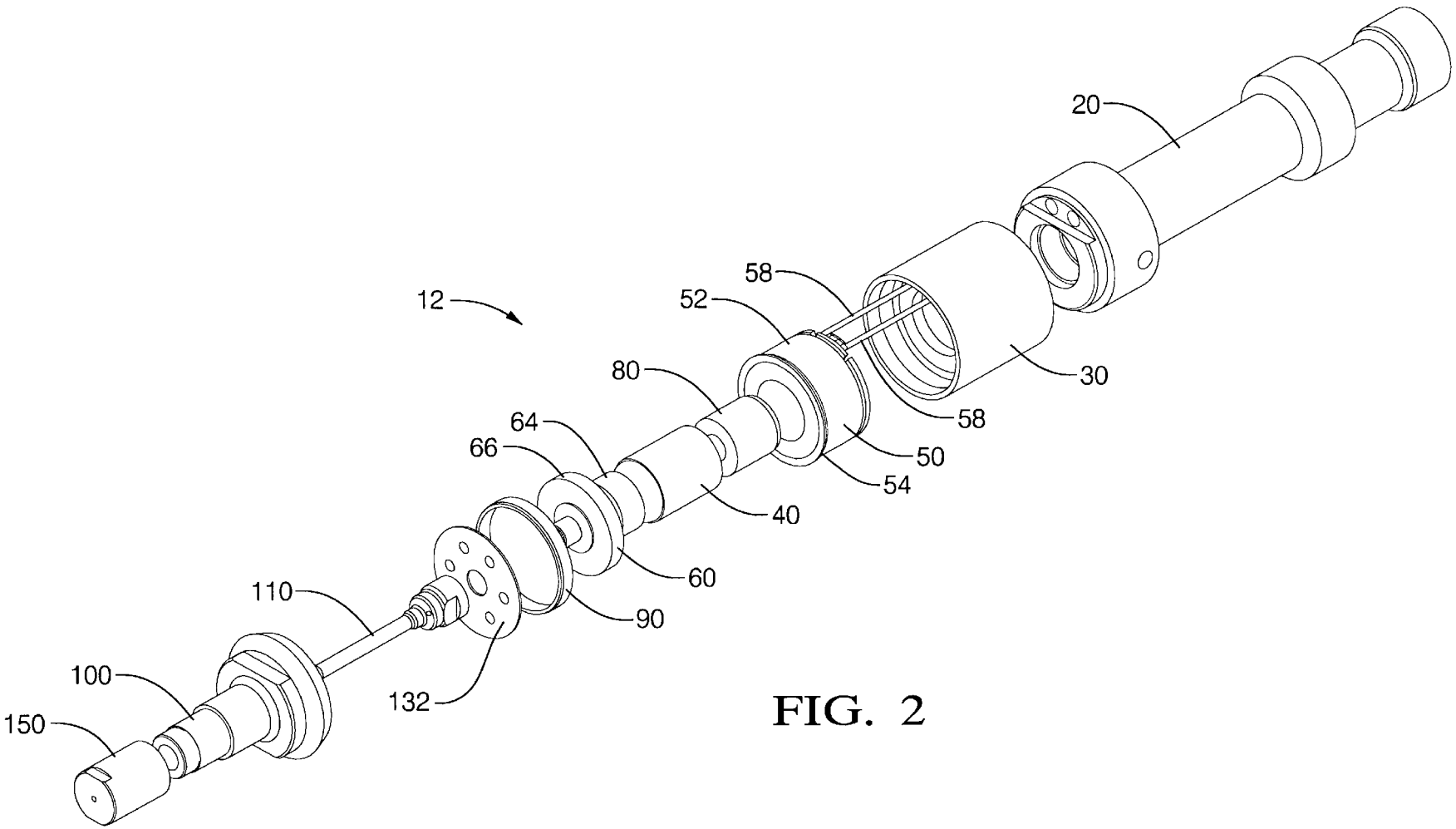
FIG. 2 is an exploded perspective view of the fuel injector of FIG. 1.

In FIGS. 1–5 there is illustrated a fuel injection system useful to deliver finely atomized fuel to a cylinder of an internal combustion engine, not shown. Referring to FIGS. 1–3, the electromagnetic fuel injector 12 of the present invention includes a generally cylindrical upper body section 20 having an axial fuel passage 22 through the upper body section 20. Preferably, the maximum outside diameter of the upper body section is 17 mm, although the principles of the present invention may be applied to any size fuel injector. The upper body section 20 includes an upper cavity 24 for receiving a filter (not shown). The upper body section includes a cavity 26 at its lower end 28.

A middle body section 30 is attached to the upper body section 20 at the lower end 28 of the upper body section 20. The middle body section 30 is also generally cylindrical, although other shapes are possible. The middle body section 30 has a cylindrical cavity 32 with a horizontal stop shoulder 34 extending partially into the cavity 32. A guide tube 40 is mounted within the middle body section 30 and is preferably welded in place. The portion of the cavity 32 of the middle body section 30 above the stop shoulder 34 and outside of the guide tube 40 defines a dry cavity 42 which receives a solenoid 50.

The solenoid 50 has a top end 52 and a bottom end 54 with windings 56 around a core 51. The solenoid 50, when energized, creates a magnetic flux path 53 (FIG. 3) and exerts an axial force on an armature 60 in a direction toward the upper body section 20. The solenoid 50 has terminals 58 which exit the fuel injector in a vertical orientation adjacent the upper body section 20.

The armature 60 is mounted for axial movement within the guide tube 40 and has a fuel passage 62 through it. The armature 60 is biased in a direction away from the upper body 20. The armature 60 has an upper section 64 which is cylindrical and has a lower section 66 which is also cylindrical. The lower section 66 has a larger diameter than the upper section 64, forming a T-shaped cross-section. The top 68 of the lower section 66 of the armature defines a first shoulder 70 and the top 72 of the upper section 64 of the armature 60 defines a second shoulder 74.

A plug 80 is mounted within the guide tube 40 in a tight fitting relationship with the upper body 20. The plug 80 has a fuel passage 81 through it. The top of the plug 80 is received within the cavity 26 in the upper body 20. The armature 60 moves from its lower position when the solenoid 50 is not energized to its upper position where the first shoulder 70 of the armature 60 contacts the stop shoulder 34 of the middle body section 30 and the second shoulder 74 of the armature 60 contacts the bottom 82 of the plug 80. There are two air gaps 84 and 86 which are closed when the armature 60 moves from its lower position to its upper position. The first air gap 84 is between the armature 60 and the stop shoulder 34 on the middle body section 30. The second air gap 86 is between the armature 60 and the plug 80. The two air gaps 84 and 86 must be equal in height, otherwise, the armature 60 will stop after contacting only one of the two stops 34 and 82.

During assembly, the plug 80 is inserted into the guide tube 40 and partially into the cavity 26 in the upper body section 20. Next the armature 60 is inserted into the guide tube 40. The second stop shoulder 74 contacts the bottom 82 of the plug 80. The armature 60 is pushed upward until the first shoulder 70 contacts the stop shoulder 34 of the middle body section 30. When this occurs the armature 60 and the plug 80 both stop moving. Because the plug 80 is in a tight fitting relationship with the upper body 20, it will remain in place when the armature 60 is moved back to its lower position. Thus, the plug 80 has been positioned in the cavity 26 in the precise location to ensure that the air gap 86 between the armature 60 and plug 80 and the air gap 84 between the armature 60 and stop shoulder 34 will be equal when the armature 60 moves to its lower position.

The highest magnetic force generated by the solenoid 50 is between the top 52 and bottom 54 of the solenoid 50.

Thus, the second air gap 86 is optimally positioned between the top 52 and bottom 54 of the solenoid 50.

A spacer 90 is located within the middle body section 30 and surrounds the lower section 66 of the armature 60. The thickness of the spacer 90 is greater than the thickness of the lower section 66 of the armature 60. The stroke of the armature 60 is approximately equal to the difference in thickness between the lower section 66 of the armature 60 and the spacer 90.

A generally cylindrical lower body section 100 is attached to the middle body section 30. A pintle 110 is connected to the armature and is disposed axially within the fuel injector 12. The pintle 110 has at least one fuel passage (not shown) through it. The pintle 110 is connected to a valve 120.

As shown in FIG. 3, the fuel injector has a low rate spring 130 and a high rate spring 132. A spring adjusting member 134 is located within the fuel passage 22 of the upper body 20 and has a shoulder 136 at its bottom end 138. The low rate spring 130 is positioned between the shoulder 136 of the spring adjusting member 134 and a spring shoulder 140 on the inside diameter of the armature 60. The high rate spring 132 is in the form of a flat disk. The high rate spring 132 is between the spacer 90 and the lower body section 100. The high rate spring 132 has a hole 133 through its center. The armature 60 is located on one side of the high rate spring 132 and the pintle 110 is located on the other side of the high rate spring 132. As the armature 60 and pintle 110 move upward under the force of the solenoid 50, both the high rate spring 132 and the low rate spring 130 act to bias the pintle 110 in a direction away from the upper body section 20.

The lower body section 100 has a valve seat 150 for receiving the valve 120 (FIG. 1). When the pintle 110 is moved upward by the solenoid 50, the valve 120 is lifted off of the valve seat 150 to permit fuel (not shown) to exit the fuel injector 12 from its injection port 152.

Figure 4:
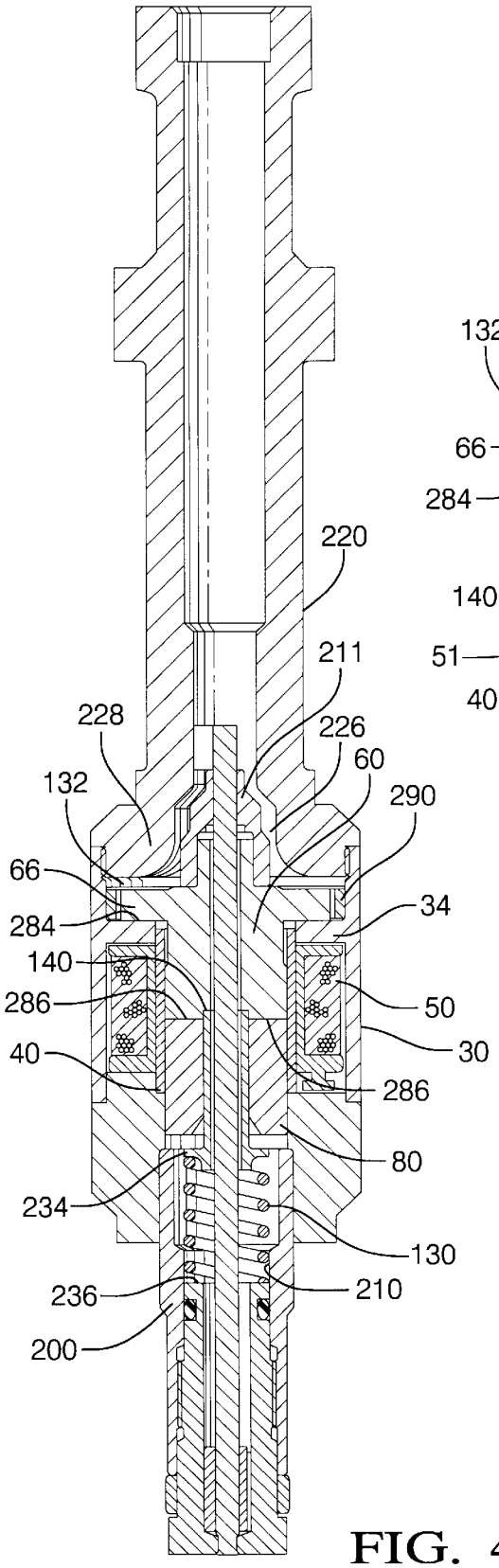
FIG. 4 is a cross-sectional view of an outwardly opening fuel injector incorporating the present invention.
Figure 5:
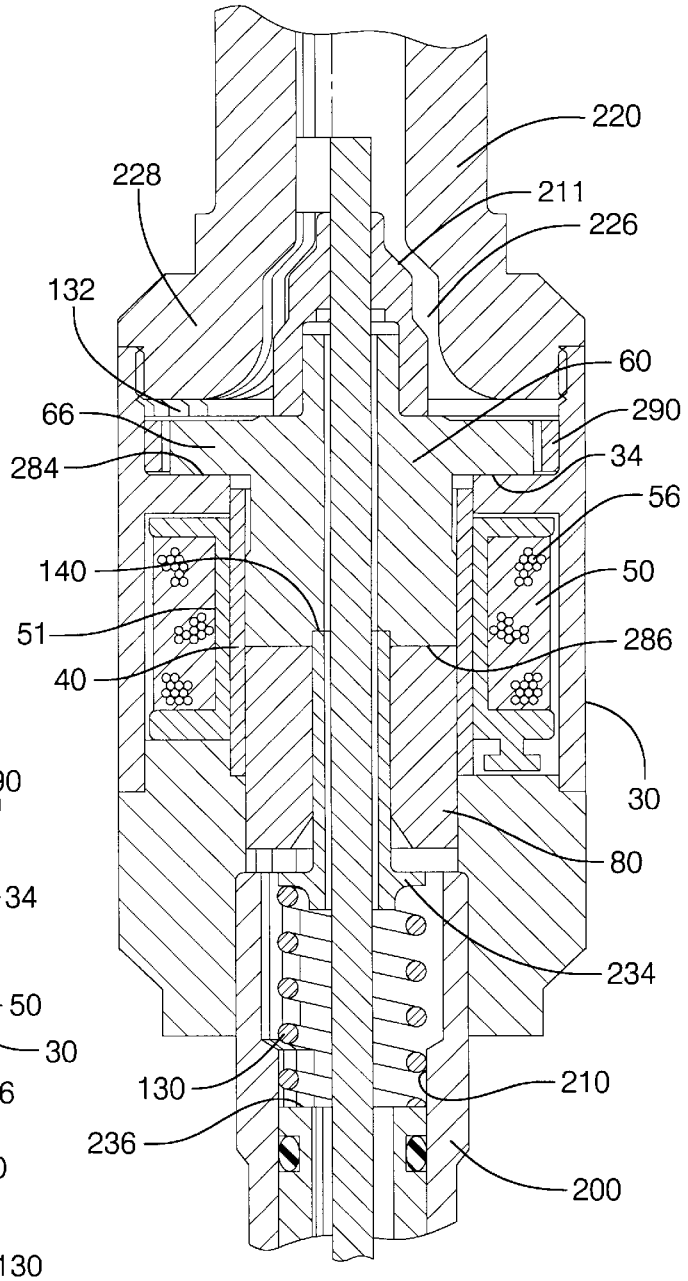
FIG. 5 is a cross-sectional view of a portion of the fuel injector shown in FIG. 4.

The forgoing describes an inwardly opening fuel injector. If the fuel injector has modular parts, i.e. if the middle body section is not integral with either the upper body section or the lower body section, the orientation of the middle body section 30 could be reversed, as shown in FIGS. 4–5. The armature 60 and solenoid 50 are also designed to be reversible such that upon energizing the solenoid 50, the armature 60 would move down instead of up. In the outwardly opening injector, the plug 80 is below the armature 60. In this orientation, a different upper body section 220 and lower body section 200 would be used. Also, a different pintle 210 would be used which is adapted to be attached to the opposite end of the armature 60. The low rate spring 130 is in the lower body section 200 and the high rate spring 132 is in the middle body section 30 adjacent the upper body section 220. The springs 130 and 132 bias the pintle 210 toward the upper body section 220. The low rate spring 130 acts between a shoulder 236 and an extension member 234 which extends up through the plug 80 to the armature 60 and contacts the shoulder 140 of the armature 60. A pintle attachment member 211 is used to attached the pintle 210 to the armature 60. The pintle attachment member 211 is disposed in a cavity 226 at the lower end 228 of the upper body section 220.

The armature 60 moves between an upper position where the armature 60 is adjacent the upper body section 220 to a lower position where the shoulder 66 contacts the stop shoulder 34. When this occurs, the shoulder 74 of the armature 60 contacts the plug 80.

The adjustment of the air gaps in the outwardly opening configuration is similar to the adjustment in the inwardly opening configuration. The plug 80 is inserted first into the guide tube 40. Then the armature 60 is inserted into the guide tube 40 and pushed downward until the armature 60 stops moving. Because the plug 80 is in a tight-fitting relationship with the upper body 200, the plug 80 will remain in place. The plug 80 will thus be positioned in the precise location to ensure that the air gaps 284 and 286 are equal in height.

A spacer 290 surrounds the lower section 66 of the armature 60. The stroke of the armature 60 is approximately equal to the difference between the thickness of the spacer 290 and the thickness of the lower section 66.

The foregoing description of the preferred embodiment of the invention has been presented for the purpose of illustration and description. It is not intended to be exhaustive nor is it intended to limit the invention to the precise form disclosed. It will be apparent to those skilled in the art that the disclosed embodiment may be modified in light of the above teachings. The embodiment described was chosen to provide an illustration of the principles of the invention and of its practical application to thereby enable one of ordinary skill in the art to utilize the invention in various embodiments and with various modifications as are suited to the particular use contemplated. Therefore, the foregoing description is to be considered exemplary, rather than limiting, and the true scope of the invention is that described in the following claims.

We claim:

1. A solenoid assembly for use in a fuel injector having an injection port comprising:

a middle body section having a first end, a second end and a cavity therein;

an armature having a first end, a second end and a fuel passage therethrough;

a solenoid mounted within the cavity of the middle body section and having a first end, a second end and windings adapted to exert an axial force on the armature;

the middle body section, the armature and the solenoid adapted to operate in each of two positions, a first position wherein a first pintle is attached to the armature and the first ends of the armature, middle body section and the solenoid are proximal to the injection port and a second position wherein a second pintle is attached to the armature and the second ends of the armature, middle body section and the solenoid are proximal the injection port such that in the first position, the solenoid exerts a force on the first pintle in one axial direction and in the second position, the soleniod exerts a force on the second pintle in the opposite axial direction.

2. An electromagnetic fuel injector comprising:

an upper body section having an axial fuel passage therethrough and a cavity therein;

a middle body section connected to the upper body section and having a cavity therein and a stop shoulder within the cavity;

a guide tube mounted within the middle body section;

a plug member mounted within the guide tube and within the cavity in the upper body section in a tight fitting relationship with the upper body section;

an armature mounted for axial movement within the guide tube, the armature having a fuel passage therethrough, the armature biased in a direction away from the upper body section, the armature having a first shoulder, a second shoulder, an upper portion and a lower portion, the upper portion adapted to be inserted within the guide tube, such that the first shoulder contacts the stop shoulder and the second shoulder contacts the plug member;

a solenoid mounted within the cavity of the middle body section surrounding the guide tube, the solenoid having a top end and a bottom end, the second shoulder of the armature disposed between the top end and the bottom end of the solenoid, the solenoid adapted to exert an axial force on the armature in a direction toward the upper body section;

a spacer within the middle body section adapted to surround the lower portion of the armature;

a pintle connected to the armature and disposed axially within the fuel injector, the pintle having a fuel passage therethrough and connected to a valve member;

a lower body section connected to the middle body section and having an axial bore therethrough for receiving the pintle, the lower body section having a valve seat for receiving the valve member wherein the armature moves between a first position wherein the valve member contacts the valve seat and a second position wherein the first shoulder contacts the stop shoulder and the second shoulder contacts the plug.

3. The apparatus of claim 2 wherein the armature is biased toward the valve seat by a spring.

4. The apparatus of claim 3 further including a spring adjust within the fuel passage of the upper body and having a shoulder thereon and a spring adapted to contact the shoulder on the spring adjust at a first end and the armature at a second end.

5. The apparatus of claim 2 further including a spring mounted between the spacer and the lower body section and connected to one of the pintle and the armature such that the spring biases the pintle in a direction away from the upper body.

6. The apparatus of claim 2 further including a spring mounted between the spacer and the lower body section and between the pintle and the armature such that the spring biases the pintle in a direction away from the upper body section.

7. The apparatus of claim 2 further including a spring adjust within the fuel passage of the upper body section and having a shoulder thereon and a spring adapted to contact the shoulder on the spring adjust at a first end and the armature at a second end and including a spring mounted between the spacer and the lower body section and connected to one of the pintle and the armature such that the spring biases the pintle in a direction away from the upper body section.

8. The apparatus of claim 2 further including a spring adjust within the fuel passage of the upper body section and having a shoulder thereon and a spring adapted to contact the shoulder on the spring adjust at a first end and the armature at a second end and including a spring mounted between the spacer and the lower body section and between the pintle and the armature such that the spring biases the pintle in a direction away from the upper body section.

9. An electromagnetic fuel injector comprising:

an upper body section having an axial fuel passage therethrough and a cavity therein;

a middle body section connected to the upper body section and having a cavity therein and a stop shoulder;

an armature mounted for axial movement within the middle body section, the armature having a shoulder and a lower portion;

a solenoid mounted within the middle body section, the solenoid adapted to exert an axial force on the armature in a direction toward the upper body section;

a spacer within the middle body section and adapted to surround the lower portion of the armature;

a pintle connected to the armature and disposed axially within the fuel injector, the pintle connected to a valve member;

a lower body section connected to the middle body section and having an axial bore therethrough for receiving the pintle, the lower body section having a valve seat for receiving the valve member;

a spring member disposed between the spacer and the lower body section, the spring member attached to one of the pintle and the armature such that the spring member biases the armature in a direction toward the lower body section and wherein the armature moves between a first position wherein the valve member contacts the valve seat and a second position wherein the shoulder contacts the stop shoulder.

10. The apparatus of claim 9 further including a plug member disposed between the upper body section and the armature, and wherein the armature further includes a second shoulder, and wherein the second shoulder contacts the plug and the shoulder contacts the stop shoulder when the armature is in the second position.

11. A method of assembling an electromagnetic fuel injector having an upper body section, a middle body section having a stop shoulder, a lower body section, a solenoid within the middle body section and a pintle comprising the steps of:

inserting a guide tube within the middle body section;

inserting a plug member partially into the guide tube;

inserting an armature into the guide tube, the armature having a first shoulder, a second shoulder, an upper portion and a lower portion; and moving the armature and the plug member toward the upper body section until the second shoulder contacts the plug member and until the first shoulder contacts the stop shoulder on the middle body section.

12. The method of claim 11 further including the step of:

inserting a spacer into the middle body section to surround the lower portion of the armature;

attaching the pintle to the armature; and and attaching the lower body section to the middle body section.

* * * * *